US008777347B2

(12) United States Patent
Shinkawa et al.

(10) Patent No.: US 8,777,347 B2
(45) Date of Patent: Jul. 15, 2014

(54) LIQUID DISCHARGING APPARATUS, INSPECTION METHOD, AND MEDIUM HAVING RECORDED PROGRAM

(75) Inventors: Osamu Shinkawa, Nagano (JP); Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 166 days.

(21) Appl. No.: 13/445,992

(22) Filed: Apr. 13, 2012

(65) Prior Publication Data

US 2012/0262511 A1 Oct. 18, 2012

(30) Foreign Application Priority Data

Apr. 13, 2011 (JP) ..... 2011-088828

(51) Int. Cl.
*B41J 29/38* (2006.01)

(52) U.S. Cl.
USPC ..... 347/10; 347/5; 347/9; 347/11

(58) Field of Classification Search
CPC ..... B41J 29/38
See application file for complete search history.

(56) References Cited

U.S. PATENT DOCUMENTS

| | | | | |
|---|---|---|---|---|
| 6,454,377 | B1 * | 9/2002 | Ishizaki | 347/15 |
| 6,945,627 | B2 * | 9/2005 | Yamaguchi | 347/27 |
| 7,387,356 | B2 * | 6/2008 | Shinkawa et al. | 347/19 |
| 2005/0057596 | A1 | 3/2005 | Shinkawa et al. | |
| 2005/0212845 | A1 | 9/2005 | Shinkawa | |
| 2007/0070102 | A1 * | 3/2007 | Takata | 347/10 |
| 2009/0244134 | A1 * | 10/2009 | Shinohara | 347/10 |
| 2010/0238211 | A1 | 9/2010 | Usuda et al. | |
| 2010/0247743 | A1 * | 9/2010 | Komori et al. | 427/8 |
| 2010/0302295 | A1 * | 12/2010 | Watanabe | 347/14 |

FOREIGN PATENT DOCUMENTS

| | | | |
|---|---|---|---|
| EP | 1600294 | A1 | 11/2005 |
| JP | 2004-314457 | A | 11/2004 |
| JP | 2005-305992 | A | 11/2005 |
| JP | 2010-221499 | A | 10/2010 |
| WO | WO-2004/076180 | A1 | 9/2004 |

* cited by examiner

*Primary Examiner* — Manish S Shah
*Assistant Examiner* — Jeremy DeLozier
(74) *Attorney, Agent, or Firm* — Global IP Counselors, LLP

(57) ABSTRACT

A printer has a plurality of dischargers for discharging ink, a detector for detecting an electric signal SW, and an inspector unit for inspecting the dischargers on the basis of the electric signal SW; and a grounding terminal connecting a drive element of a discharger being inspected is electrically disconnected from another grounding terminal and a grounding line GL when the electric signal SW is detected by the detector.

9 Claims, 11 Drawing Sheets

LIQUID DISCHARGING APPARATUS, INSPECTION METHOD, AND MEDIUM HAVING RECORDED PROGRAM

CROSS-REFERENCE TO RELATED APPLICATIONS

This application claims priority to Japanese Patent Application No. 2011-088828 filed on Apr. 13, 2011. The entire disclosure of Japanese Patent Application No. 2011-088828 is hereby incorporated herein by reference.

BACKGROUND

1. Technical Field

The present invention relates to a technique for inspecting a discharger of a liquid discharging apparatus.

2. Background Technology

An inkjet printer, which is one type of liquid discharging apparatus, has a plurality of dischargers for discharging ink; in each discharger, ink is stored in a cavity communicating with a nozzle, and discharged from the nozzle by driving provided by a drive element (piezoelectric element) provided within the cavity. Each drive element within the plurality of dischargers is connected by an analog switch to a shared circuit to which a drive signal is applied, and when ink is discharged from the nozzle, an analog switch corresponding to the drive element of a discharger from which the ink is discharged is switched to an ON state (conductive state), an analog switch corresponding to the drive element of a discharger from which the ink is not discharged is switched to an OFF state (non-conductive state), and a drive signal is applied to the shared circuit.

When air bubbles are present in the ink contained within the cavity of the discharger of the liquid discharging apparatus, or when the ink within the cavity thickens, there is a risk of the nozzle becoming clogged, impeding satisfactory ink discharge from the nozzle. A technique has been proposed of inspecting for clogs in a discharger nozzle on the basis of residual vibration from the driving of the drive element in the ink remaining in the cavity (for example, see Patent Citation 1). In this technique, when inspecting for nozzle clogs, after an analog switch corresponding to the drive unit of the discharger being inspected is switched to an ON state, analog switches corresponding to other drive elements are switched to an OFF state, a drive signal is applied to the shared circuit, an electric signal corresponding to the residual vibration output from the drive element of the discharger being inspected is detected, and the discharger is inspected based upon this electric signal.

Japanese Laid-open Patent Publication No. 2005-305992 (Patent Document 1) is an example of the related art.

SUMMARY

However, there was a problem in the past because a parasitic capacity would form in the analog switch connecting the drive element and the shared circuit when in an OFF state, the charge generated in the drive element of the discharger being inspected would leak into the parasitic capacity of the analog switch corresponding to the drive element of a discharger other than the unit being inspected, reducing the signal level of the electric signal corresponding to the residual vibration. As a result, there was a risk of false inspection determinations when a suitable signal-to-noise ratio (S/N) for the electric signal corresponding to the residual vibration could not be obtained.

In light of the problem described above, an advantage of the invention is to provide a technique enabling the suppression of false determinations during residual vibration-based discharger inspection.

The invention is contrived in order to resolve the problem described above at least in part, and can be effected by an embodiment or exemplary application as described below.

First Exemplary Application

A liquid discharging apparatus according to a first exemplary application has a grounding line; a first discharger for discharging, by driving of a first drive element, a liquid in a first cavity through a first nozzle communicating with the first cavity; a first grounding terminal connecting the first drive element to the grounding line; a second discharger for discharging, by driving of a second drive element, a liquid in a second cavity through a second nozzle communicating with the second cavity; a second grounding terminal connecting the second drive element to the grounding line; a shared circuit selectively connectable to the first drive element and the second drive element via respective analog switches; a drive control unit for controlling the driving of each of the first drive element and the second drive element via the shared circuit; a switch unit for electrically disconnecting the first grounding terminal from the second grounding terminal and the grounding line; a detector for detecting an electric signal from the first drive element via the first grounding terminal when the first grounding terminal is electrically disconnected from the second grounding terminal and the grounding line; and an inspector unit for inspecting the first discharger based on the electric signal. Because the first grounding terminal and the second grounding terminal of the liquid discharging apparatus of the first exemplary application are electrically disconnected when the electric signal from the first drive element is being detected, it is possible to suppress a reduction in the level of the electric signal arising from the parasitic capacity of the analog switch. As a result, it is possible to suppress false determinations during discharger inspection.

Second Exemplary Application

A liquid discharging apparatus according to the first exemplary application can further have a third discharger for discharging, by driving of a third drive element, a liquid in a third cavity through a third nozzle communicating with the third cavity; and a fourth discharger for discharging, by driving of a fourth drive element, a liquid in a fourth cavity through a fourth nozzle communicating with the fourth cavity; the third drive element being connected to the grounding line along with the first drive element via the first grounding terminal, and the fourth drive element being connected to the grounding line along with the second drive element via the second grounding terminal. The liquid discharging apparatus according to the second exemplary application allows for a simpler configuration than if a separate grounding terminal were provided for each drive element.

Third Exemplary Application

In a liquid discharging apparatus according to the second exemplary application, the first discharger and the third discharger can be incorporated in a first unit in which the first grounding terminal is formed, and the second discharger and the fourth discharger incorporated in a second unit in which the second grounding terminal is formed. The liquid discharging apparatus according to the third exemplary application allows for a simpler configuration than if the correspondence between drive element and grounding terminal were across more than one unit.

Fourth Exemplary Application

In a liquid discharging apparatus according to the second exemplary application or the third exemplary application, the liquid is discharged at different timings by the first and third dischargers, and the second and fourth dischargers, respectively. The liquid discharging apparatus according to the fourth exemplary application allows for easier discharger inspection while liquid is being discharged than if discharge units with different liquid discharge timings were connected to a grounding line via a shared grounding terminal.

Fifth Exemplary Application

In a liquid discharging apparatus according to one of the first exemplary application through the fourth exemplary application, the switch unit can include a first switch for electrically disconnecting the first grounding terminal from the grounding line when the detector detects the electric signal; a second switch for electrically disconnecting the second grounding terminal from the grounding line when the detector detects the electric signal; and a third switch for electrically connecting the first grounding terminal to the detector and electrically disconnecting the second grounding terminal from the detector prior to the disconnection performed by the first switch and the second switch. The liquid discharging apparatus according to the fifth exemplary application allows for a simpler switch unit configuration.

Sixth Exemplary Application

In a liquid discharging apparatus according to one of the first exemplary application through the fourth exemplary application, the switch unit can include a first switch for electrically disconnecting the first grounding terminal from the grounding line when the detector detects the electric signal; a second switch for electrically disconnecting the second grounding terminal from the grounding line when the detector detects the electric signal; a third switch for electrically connecting the first grounding terminal to a detection circuit electrically connected to the detector and the grounding line and electrically disconnecting the second grounding terminal from the detection circuit prior to the disconnection performed by the first switch and the second switch; and a fourth switch for electrically disconnecting the detection circuit from the grounding line after the disconnection performed by the first switch and the second switch when the electric signal is detected by the detector. The liquid discharging apparatus according to the fifth exemplary application allows the switch unit to perform switching more quickly than if the detection circuit were electrically disconnected from the grounding line with no fourth switch provided.

Seventh Exemplary Application

In a liquid discharging apparatus according to one of the first exemplary application through the sixth exemplary application, drive control unit can drive the first drive element and the second drive element at a level such that liquid is not discharged, and then drive the first drive element at a level such that residual vibration by the driving of the first drive element is generated. The liquid discharging apparatus according to the seventh exemplary application makes it possible to agitate the liquid within the cavity of the second discharger, preventing the liquid within the second discharger thickening.

Eighth Exemplary Application

An inspection method according to an eighth exemplary application is a method of inspecting a liquid discharging apparatus having a first discharger for discharging, by driving of a first drive element, a liquid in a first cavity through a first nozzle communicating with the first cavity, the first drive element being connected to a grounding line via a first grounding terminal; and a second discharger for discharging, by driving of a second drive element, a liquid in a second cavity through a second nozzle communicating with the second cavity, the second drive element being connected to a grounding line via a second grounding terminal; wherein the driving of each of the first drive element and the second drive element are controlled via a shared circuit selectively connectable to the first drive element and the second drive element via respective analog switches, an electric signal from the first drive element is detected via the first grounding terminal with the first grounding terminal in a state of electric disconnection from the second grounding terminal and the grounding line, and the first discharger is inspected based upon the electric signal. In the inspection method of the eighth exemplary application, because the grounding line side of the first drive element and the grounding line side of the second drive element are electrically disconnected when the electric signal from the first drive element is being detected, it is possible to suppress a reduction in the level of the electric signal arising from a parasitic capacity of the analog switch. As a result, it is possible to suppress false determinations during discharger inspection.

Ninth Exemplary Application

A medium having recorded program according to a ninth exemplary application is a medium having recorded program for causing a computer to execute a function of inspecting a liquid discharging apparatus, the apparatus including: a first discharger for discharging, by driving of a first drive element, a liquid in a first cavity through a first nozzle communicating with the first cavity, the first drive element being connected to a grounding line via a first grounding terminal; and a second discharger for discharging, by driving of a second drive element, a liquid in a second cavity through a second nozzle communicating with the second cavity, the second drive element being connected to a grounding line via a second grounding terminal; wherein the program is adapted for executing functions of: controlling the driving of each of the first drive element and the second drive element via a shared circuit selectively connectable to the first drive element and the second drive element; detecting an electric signal from the first drive element via the first grounding terminal, the first grounding terminal in a state of being electrically disconnected from the second grounding terminal and the grounding line; and inspecting the first discharger based on the electric signal; and the medium is accessible by a computer. Because the grounding line side of the first drive element and the grounding line side of the second drive element are electrically disconnected when the electric signal from the first drive element is being detected, the medium having recorded program of the ninth exemplary application makes it possible to suppress a reduction in the level of the electric signal arising from a parasitic capacity of the analog switch. As a result, it is possible to suppress false determinations during discharger inspection.

The embodiment of the invention is not limited to a liquid discharging apparatus, inspection method and program; it can also be applied to other embodiments such as a discharge apparatus for discharging a fluid in which a solid is dispersed in a liquid or gas, apart from the specific form of a liquid discharging apparatus such as an inkjet printer. The invention is in no way limited to the embodiments described above, and a variety of embodiments within the scope of the invention are possible.

BRIEF DESCRIPTION OF THE DRAWINGS

Referring now to the attached drawings which form a part of this original disclosure.

DETAILED DESCRIPTION OF EXEMPLARY EMBODIMENTS

A liquid discharging apparatus to which the invention has been applied will be described hereafter in order to further elucidate the configuration and operation of the invention described above.

A. First Embodiment

Figure 1:
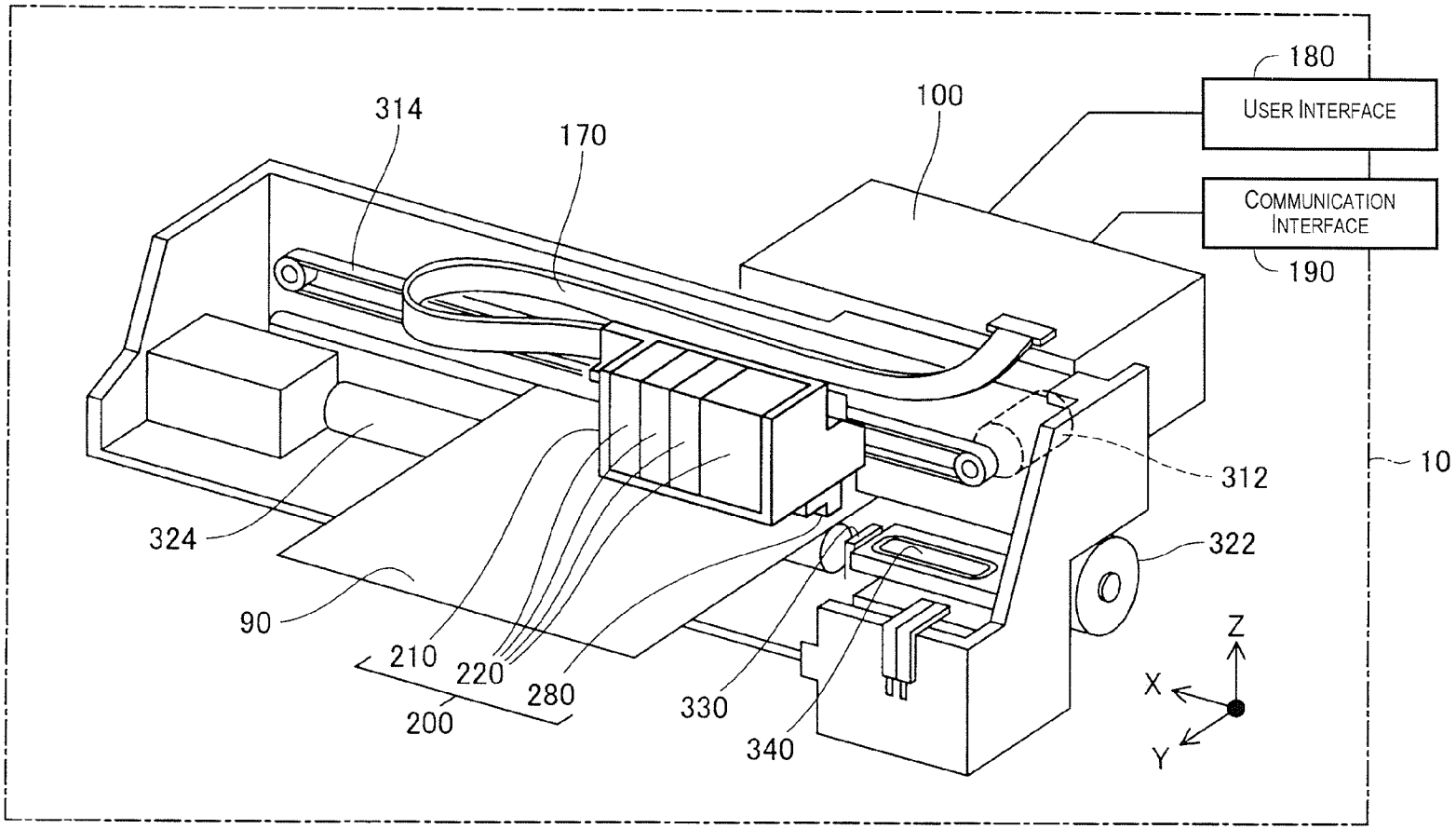
FIG. 1 is an illustration of the configuration of a printer.

A1. Printer Configuration:

FIG. 1 is an illustration of the configuration of a printer 10. The printer 10 is an inkjet printer, which is one type of liquid discharging apparatus for discharging a liquid that prints data such as characters, figures, and images on a print medium 90 such as paper or a label by discharging liquid ink. The printer 10 has a control unit 100, a user interface 180, a communication interface 190, and a head unit 200.

The user interface 180 of the printer 10 has a display, an operation button, and the like, and exchanges information with a user of the printer 10. The communication interface 190 exchanges information with an external device such as a personal computer electrically connectable with the printer 10, a digital still camera, a memory card, or the like. The head unit 200 of the printer 10 has an ink discharge mechanism for discharging ink. The ink discharge mechanism will be described in detail below.

The control unit 100 of the printer 10 controls the various parts of the printer 10. For example, the control unit 100 performs printing control so that ink droplets are discharged from the head unit 200 based on data input via the communication interface 190 while the head unit 200 and the print medium 90 are made to move relative to each other. In this way, printing of the print medium 90 is performed.

In this embodiment, the control unit 100 is a device having a CPU (Central Processing Unit), ROM (Read Only Memory), RAM (Random Access Memory), an input/output interface, and the like, and various functions of the control unit 100 are executed by operation of the CPU according to a computer program. At least a part of the functions of the control unit 100 can be executed by an electronic circuit of the control unit 100 operating according to a circuit configuration thereof.

The head unit 200 of this embodiment has a carriage 210, an ink cartridge 220, and a head 280. The carriage 210 of the head unit 200 is connected to the control unit 100 via a flexible cable 170, and is movably configured, with the ink cartridge 220 and head 280 installed therein. The ink cartridge 220 of the head unit 200 contains ink therein, and supplies the ink to the head 280. In this embodiment, a plurality of ink cartridges 220 for each ink color (photo black, matte black, cyan, magenta, and yellow; 5 altogether) are installed in the carriage 210. The head 280 of the head unit 200 is in a position facing the print medium 90, and ink supplied to the head 280 from the ink cartridge 220 is discharged in the form of droplets from the head 280 onto the print medium 90.

In this embodiment, the printer 10 has a primary scanning mechanism and a secondary scanning mechanism for causing the head unit 200 and print medium 90 to move relative to each other. The primary scanning mechanism of the printer 10 has a carriage motor 312 and a drive belt 314, and reciprocally moves the head unit 200 along a primary scanning direction by conveying the motive force of the carriage motor 312 to the head unit 200 via the drive belt 314. The secondary scanning mechanism of the printer 10 has a conveyor motor 322 and a platen 324, and conveys the print medium 90 in a secondary scanning direction intersecting the primary scanning direction by conveying the motive force of the conveyor motor 322 to the platen 324. The carriage motor 312 of the primary scanning mechanism and the conveyor motor 322 of the secondary scanning mechanism operate based on control signals from the control unit 100.

In the description of this embodiment, the coordinate axis parallel with the primary scanning direction along which the head unit 200 reciprocally moves is the X axis, the coordinate axis parallel with the secondary scanning direction in which the print medium 90 is conveyed is the Y axis, and the coordinate axis running from below to above in the direction of gravity is the Z axis. The X axis, Y axis, and Z axis each intersects the others perpendicularly.

Figure 2:
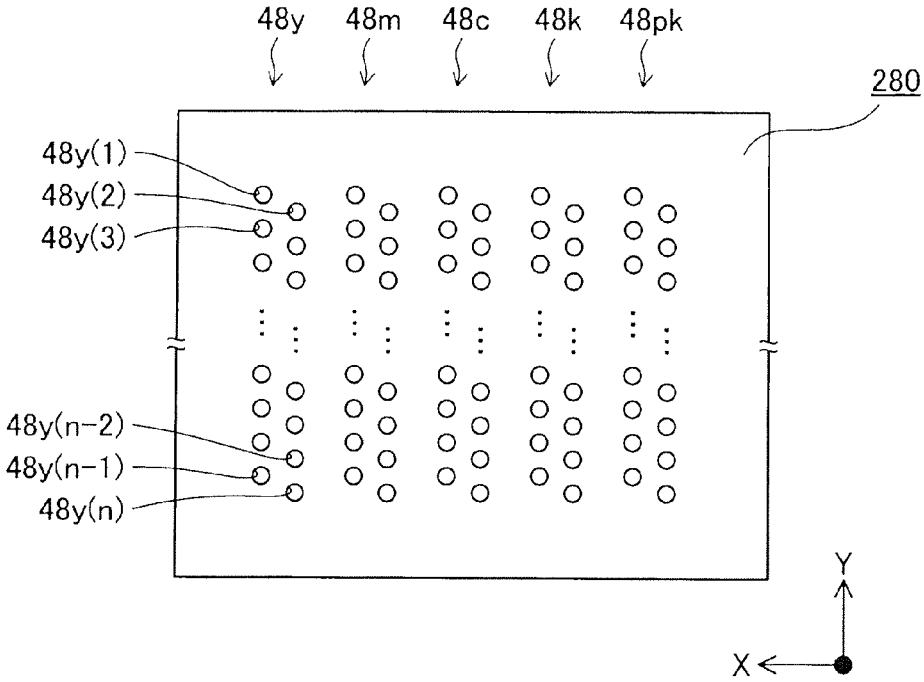
FIG. 2 is an illustration of the structure of a head within a head unit.

FIG. 2 is an illustration of the structure of a head 280 within a head unit 200. In FIG. 2, the head 280 is shown as viewed from the print medium 90. The head 280 of the head unit 200 has a plurality of nozzles 48 for discharging ink. In this embodiment, n nozzles 48 (for example, 720) are provided for each ink color (photo black, matte black, cyan, magenta, and yellow; five altogether), with the nozzles 48 for each color being disposed in the order photo black, matte black, cyan, magenta, and yellow in the primary scanning direction (X axis direction). The n nozzles 48 for each color are arranged staggered in the secondary scanning direction (Y axis direction), and, in this embodiment, are disposed in two alternating rows in the secondary scanning direction (Y axis) in order to reduce the distance between nozzles 48 in the secondary scanning direction (Y axis direction).

In the description of this embodiment, the label 48 will be used when referring to the nozzles of the head unit 200 as a whole, the label 48*pk* will be used when referring to photo black nozzles, the label 48*k* will be used when referring to matte black nozzles, the label 48*c* will be used when referring to cyan nozzles, the label 48*m* will be used when referring to magenta nozzles, and the label 48*y* will be used when referring to yellow nozzles. Labels with additional nozzle numbers will be used when referring to individual nozzles. For example, as shown in FIG. 2, the first yellow nozzle is labeled 48*y*(1), the second yellow nozzle is labeled 48*y*(2), the third yellow nozzle is labeled 48*y*(3), the n−1th yellow nozzle is labeled 48*y*(n−1), and the nth yellow nozzle is labeled 48*y*(n).

Figure 3:
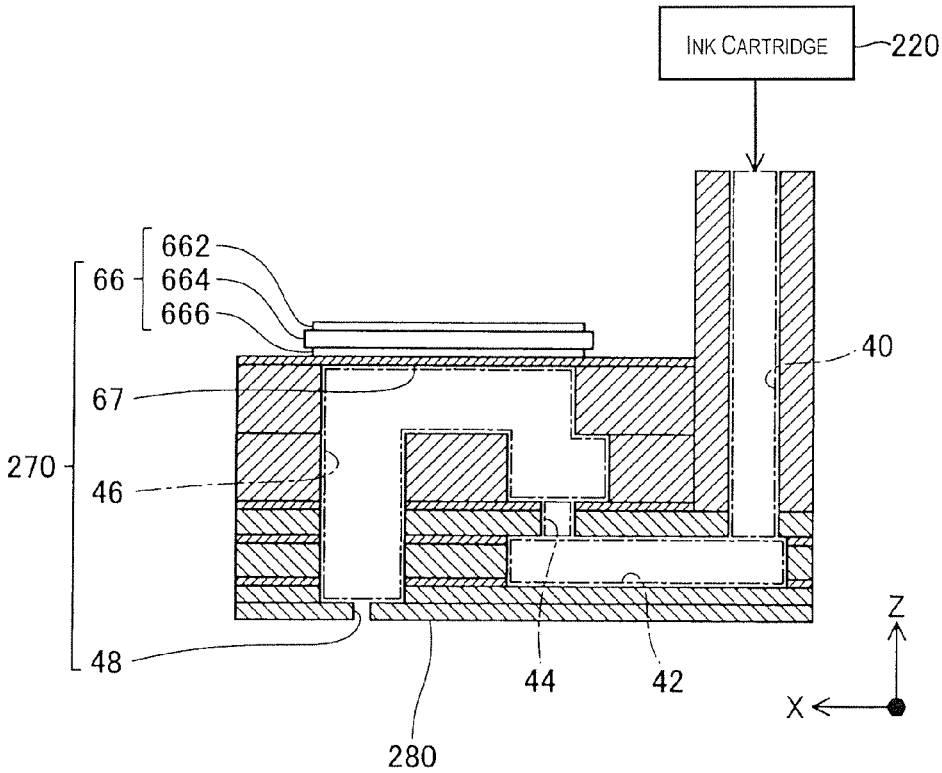
FIG. 3 is an illustration of an ink discharge mechanism within a head unit.

FIG. 3 is an illustration of an ink discharge mechanism within a head unit 200. FIG. 3 shows a cross section of the head 280 in the gravity direction (Z axis direction). The ink discharge mechanism of the head unit 200 has an intake channel 40, a reservoir 42, a supply opening 44, a cavity 46, a nozzle 48, a drive element 66, and an oscillator 67.

The ink discharge mechanism is provided with an intake channel 40 and reservoir 42 for each color, and the intake channel and reservoir form part of a channel guiding the ink out of the ink cartridge 220 through the nozzle 48. The ink supplied from the ink cartridge 220 to the head unit 200 passes through the intake channel 40 and accumulates in the reservoir 42.

The supply opening 44, cavity 46, drive element 66, and oscillator 67 of the ink discharge mechanism are provided in correspondence to each of the plurality of nozzles 48 formed in the head 280, and form a discharger 270 along with the nozzle 48. In other words, the head unit 200 has a plurality of dischargers 270 corresponding to the number of nozzles 48. The discharger 270 discharges, by driving provided by the drive element 66, ink within the cavity 46 out from the nozzle 48 communicating with the cavity 46.

The supply opening 44 and cavity 46 of the discharger 270 form part of the channel for guiding ink out of the ink cartridge 220 through the nozzle 48. The supply opening 44 is a channel between the reservoir 42 and the cavity 46, and ink is supplied from the reservoir 42 to the cavity 46 by passing through the supply opening 44. The cavity 46 is a channel communicating with the nozzle 48 having a cross section that is sufficiently greater than that of the supply opening 44 and nozzle 48, and stores ink prior to discharge.

The drive element 66 of the discharger 270 is provided on the side of the oscillator 67 opposite the cavity 46, and the oscillator 67 of the discharger 270 forms part of the wall of the channel of the cavity 46. In this embodiment, the drive element 66 is a unimorph piezoelectric actuator with a piezoelectric conductor 664 sandwiched between two electrodes 662, 666 and the oscillator 67 provided on the electrode 666 side of the actuator, but a laminated piezoelectric actuator can be used as the drive element 66 in other embodiments. The drive element 66 bends in the gravity direction (Z axis direction) on the basis of on the applied drive signal, displacing the oscillator 67. In this way, it is possible, after first increasing the volume of the cavity 46 and drawing in ink from the reservoir 42, to reduce the volume of the cavity 46 and discharge ink from the nozzle 48.

To return to FIG. 1, the printer 10 of this embodiment has a head wiper 330 and a head cap 340 as a maintenance mechanism (maintenance unit) for maintaining the head 280 of the head unit 200. The head wiper 330 of the printer 10 removes ink adhering to the head 280 by wiping off the head 280.

The head cap 340 of the printer 10 is attached to the head 280 when the head unit 200 is on standby, preventing the ink within the discharger 270 from drying out by sealing the nozzle 48. When the nozzle 48 of the discharger 270 becomes clogged, the head cap 340 is used to restore (perform maintenance) by a flushing or suctioning process. When performing flushing, the head cap 340 opposes the head 280 and catches ink droplets discharged from the nozzle 48 of the discharger 270, and, when performing suctioning, suctions deteriorated ink from the nozzle 48 while attached to the head 280. By performing restoration using the head cap 340, it is possible to restore the discharger 270 to a state in which ink can be discharged properly after the unit has become clogged with ink that has become degraded by air bubble formation or thickening.

Figure 4:
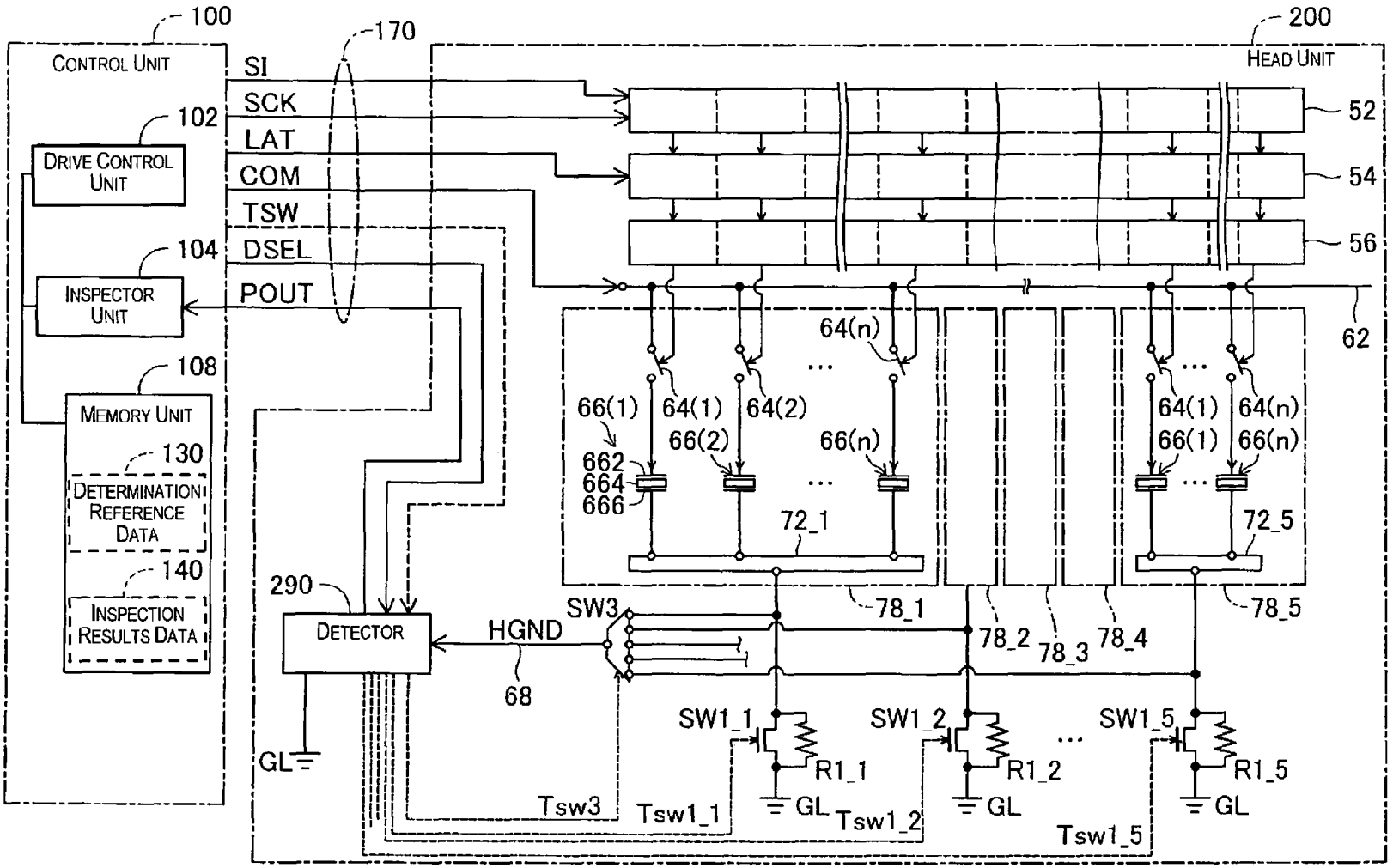
FIG. 4 is an illustration of the electronic configuration of a control unit and a head unit.

FIG. 4 is an illustration of the electronic configuration of a control unit 100 and a head unit 200. The control unit 100 has a drive control unit 102, an inspector unit 104, and a memory unit 108; and the head unit 200 has a shift resistor 52, a latching circuit 54, a level shifter 56, a shared circuit 62, a plurality of switches 64, a detection circuit 68, a grounding terminal 72, and a detector 290.

The drive control unit 102 of the control unit 100 controls the drive of the plurality of drive elements 66 of the head unit 200 through the shared circuit 62 of the head unit 200. In this example, the drive control unit 102 applies a drive signal COM that drives the drive element 66 to the shared circuit 62, and, while applying the drive signal COM, outputs a shift input signal SI, a clock signal SCK, and a latching signal LAT to the head unit 200.

The shift resistor 52 of the head unit 200 is a memory device for storing instruction data directing the operation of each drive element 66 in the plurality of dischargers 270. Instruction data corresponding to each drive element 66 is outputted in turn in the shift input signal SI from the control unit 100 synchronously with the clock signal SCK, and instruction data corresponding to each drive element 66 is stored in turn in the shift resistor 52 based on the shift input signal SI and the clock signal SCK. In this embodiment, the instruction data corresponding to each drive element 66 is 2-bit data indicating one of [0,0], [0,1], [1,0], and [1,1].

The latching circuit 54 of the head unit 200 retains the instruction data for each drive element 66 stored in the shift resistor 52 based on the latching signal LAT from the control unit 100, and outputs a logic signal corresponding to each piece of data to the level shifter 56. The latching signal LAT is outputted from the control unit 100 when all of the instruction data for each drive element 66 has been stored in the shift resistor 52. In this embodiment, the latching circuit 54 outputs a Lo level logic signal for instruction data [0,0], a Lo level logic signal followed by a Hi level one for instruction data [0,1], a Hi level logic signal followed by a Lo level one for instruction data [1,0], and a Hi level logic signal for instruction data [1,1].

The level shifter 56 of the head unit 200 outputs a voltage of a level switching each switch 64 of the plurality of switches 64 connected to each drive element 66 level shifter 56 to ON or OFF based on the logic signal outputted from the latching circuit 54. In this embodiment, the level shifter 56 outputs a voltage of a level switching the switch 64 to OFF in response to a Lo level logic signal from the latching circuit 54, and a voltage of a level switching the switch 64 to ON in response to a Hi level logic signal from the latching circuit 54.

The plurality of switches 64 in the head unit 200 switches the electrical connection between the shared circuit 62 and each drive element 66 ON or OFF, and, in this embodiment, the switches 64 are connected to the electrode 662 of the two electrodes of the drive element 66. In this embodiment, the switch 64 is an analog switch utilizing a transmission gate, and a parasitic capacity is formed in the switch 64 when in an OFF state. In the ON state, in which the drive element 66 is electrically connected by the switch 64 to the shared circuit 62, the drive signal COM applied to the shared circuit 62 is applied to the electrode 662 of the drive element 66; and in the OFF state, in which the drive element 66 is electrically disconnected from the shared circuit 62 by the switches 64, the drive signal COM applied to the shared circuit 62 is not applied to the drive element 66.

In the description of this embodiment, the label 64 will be applied when referring to switches connected to the shared circuit 62 in the head unit 200 in general, and a label including the corresponding nozzle number will be applied when referring to switches corresponding to individual nozzle numbers for each color. For example, the switch corresponding to the first nozzle for each color is labeled 64(1), the switch corresponding to the second nozzle for each color is labeled 64(2), through to the label for the switch corresponding to the nth nozzle for each color, which is labeled 64(*n*).

In the description of this embodiment, the label 66 will be applied when referring to the drive elements of the discharger 270 as a whole, and a label including the corresponding nozzle number will be applied when referring to drive elements corresponding to individual nozzle numbers for each color. For example, the drive element corresponding to the first nozzle for each color is labeled 66(1), the drive element corresponding to the second nozzle for each color is labeled 66(2), through to the label for the drive element corresponding to the nth nozzle for each color, which is labeled 66(*n*).

The grounding terminal 72 of the head unit 200 is an electric conductor relaying the electrical connection of the drive element 66 to a grounding line GL, and a switch SW1 and a resistor R1 are provided in parallel between the grounding terminal 72 and the grounding line GL. In this embodiment, the grounding terminal 72 is connected to the electrode 666 of the two electrodes of each drive element 66. The grounding line GL is an electric conductor connected to a reference potential point of the printer 10, and, in this embodiment, is connected to a housing (not illustrated) of the printer 10. In this embodiment, the switch SW1 is a switching element using a field effect transistor (FET).

In this embodiment, a grounding terminal 72 is provided for each color (photo black, matte black, cyan, magenta, and yellow; five altogether), and the grounding terminal 72 for each color connects the plurality of drive elements 66 for each color to the grounding line GL. In the description of this embodiment, the label 72 will be used when referring to the grounding terminals of the head unit 200 as a whole, and, when referring to specific grounding terminals 72 for each color, the label 72_1 when referring to the grounding terminal for photo black, the label 72_2 when referring to the grounding terminal for matte black, the label 72_3 when referring to the grounding terminal for cyan, the label 72_4 when referring to the grounding terminal for magenta, and the label 72_5 when referring to the grounding terminal for yellow.

In this embodiment, a switch SW1 and resistor R1 are provided for each grounding terminal 72. In the description of this embodiment, the labels SW1 and R1 respectively will be used when referring to the switches and resistors between the grounding terminals 72 and the grounding line GL in general. When the switches and resistors corresponding to the grounding terminals 72 are to be specified, the labels SW1_1 and R1_1 will respectively be used when referring to the switch and resistor for the grounding terminal 72_1, the labels SW1_2 and R1_2 will respectively be used when referring to the switch and resistor for the grounding terminal 72_2, and so forth through to the switch and resistor for the grounding terminal 72_5, which are labeled SW1_5 and R1_5, respectively.

In this embodiment, the switches 64, drive elements 66, and grounding terminals 72 are incorporated in a discharging unit 78 for each color (photo black, matte black, cyan, magenta, and yellow; five altogether). In the description of this embodiment, the label 78 will be used when referring to the units of the head unit 200 in general, and, when referring to units for specific colors, the unit for photo black will be labeled 78_1, the unit for matte black will be label 78_2, the unit for cyan will be label 78_3, the unit for magenta will be labeled 78_4, and the unit for yellow will be labeled 78_5. For example, in the discharging unit 78_1 in which the grounding terminal 72_1 corresponding to photo black is formed, n switches 64(1) through 64(*n*) corresponding to photo black and n drive elements 66(1) through 66(*n*) corresponding to photo black are incorporated.

The detection circuit 68 of the head unit 200 is an electrical conductor that relays the electrical connection from the grounding terminal 72 to the detector 290, and a switch SW3 is provided between the grounding terminal 72 and the detection circuit 68. The switch SW3 is a multiplexer electrically connecting one of the plurality of grounding terminals 72 (grounding terminals 72_1-5) to the detection circuit 68.

The detector 290 of the head unit 200 detects an electric signal SW corresponding to the residual vibration of the ink within the cavity 46 of the discharger 270, which is vibration remaining from the drive of the drive element 66, through the grounding terminal 72. In this embodiment, the drive element 66 functions as a sensor unit that detects residual vibration and outputs an electric signal SW corresponding to the residual vibration, and the electric signal SW output from the drive element 66 by the electromotive force of the residual vibration is applied to the grounding terminal 72. The detector 290 detects the electric signal SW corresponding to the residual vibration by measuring an electric signal HGND of the detection circuit 68 electrically connected to the grounding terminal 72 via the switch SW3. In this embodiment, the detector 290 detects an electric signal SW in response to a detection execution signal DSEL outputted from the control unit 100, and outputs a detection signal POUT indicating a detected value of the electric signal SW as detection results to the control unit 100.

In this embodiment, the detector 290 outputs, along with the detection execution signal DSEL, switch control signals Tsw1_1-5 controlling switches SW1_1-5, and a switch control signal Tsw3 controlling switch SW3 on the basis of a switch control signal TSW outputted from the control unit 100. The switches SW1_1-5 and switch SW3 function as switch units for electrically disconnecting the first grounding terminal, which is the grounding terminal 72 of the discharging unit 78 of which the drive element 66 of the discharger 270 being inspected is a part, from the second grounding terminal, which is the grounding terminal 72 of the discharging unit 78 of which the drive element 66 of the discharger 270 not being inspected is a part, and the grounding line GL based on the switch control signals Tsw1_1-5 and the switch control signal Tsw3.

Figure 5:
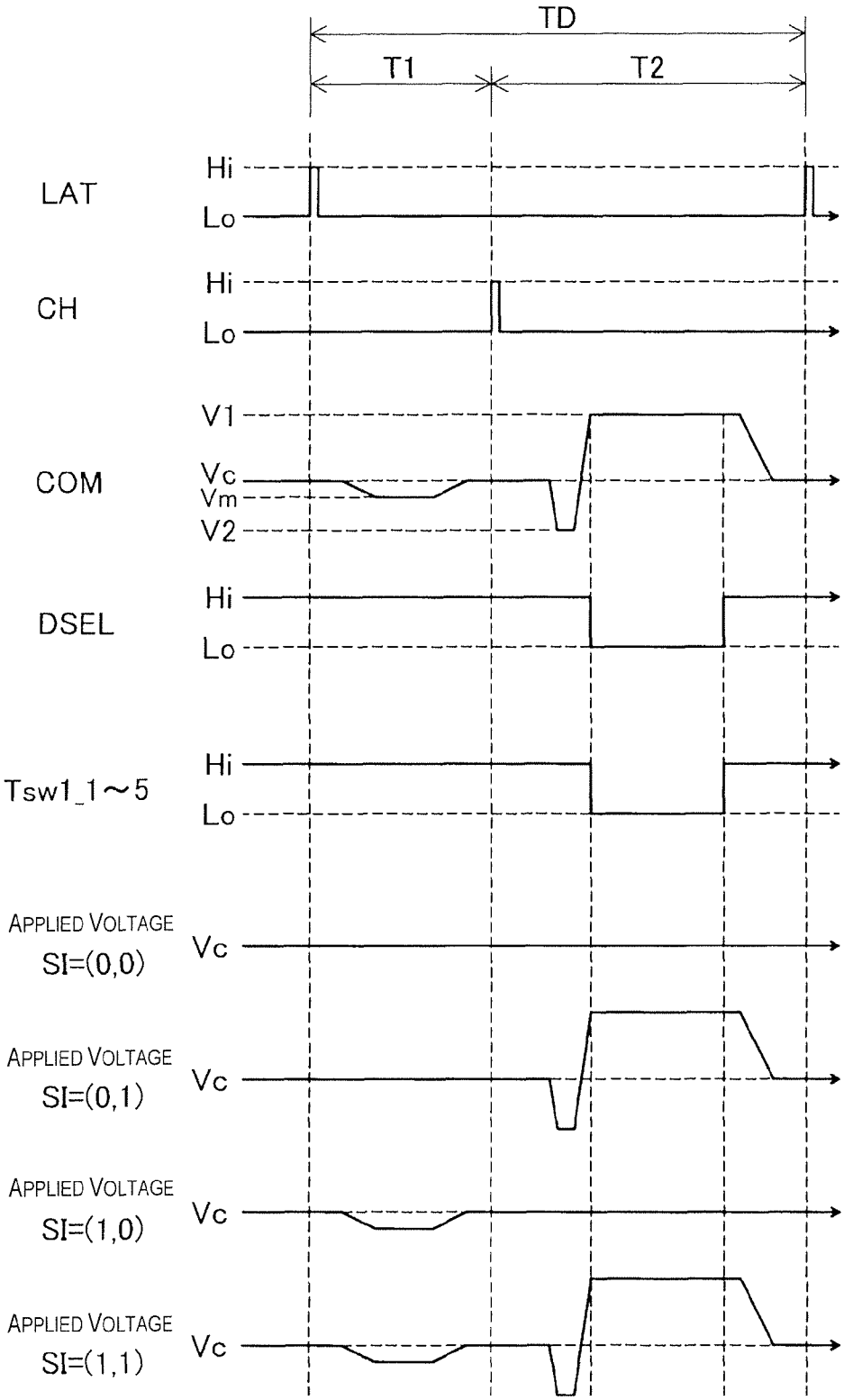
FIG. 5 is an illustration of an example of various signals of a control unit and a head unit.

FIG. 5 is an illustration of an example of various signals of a control unit 100 and a head unit 200. From the top, FIG. 5 shows the changes over time in the latching signal LAT, a switching signal CH, the drive signal COM, the detection execution signal DSEL, the switch control signals Tsw1_1-5, and, underneath that, the changes over time in the voltage applied to the drive element 66 according to the instruction data in the shift input signal SI.

The latching signal LAT is a logic signal arising according to a drive cycle TD, and is inputted from the control unit 100 to the latching circuit 54. The drive cycle TD is equivalent to the period needed to drive a drive element 66 in each discharger 270 and form one pixel on the print medium 90.

The switching signal CH is a signal generated in the head unit 200 based on the latching signal LAT, and is a logic signal arising after a fixed period of time passes after the latching signal LAT arises. The latching circuit 54 outputs a logic signal corresponding to the first bit of the 2-bit instruction data received from the shift resistor 52 during a first period T1 from when the latching signal LAT arises to when the switching signal CH arises, and a logic signal corresponding to the second bit of the instruction data during a second period T2 from when the switching signal CH arises to when the latching signal LAT arises.

The drive signal COM is a voltage signal cyclically output synchronously with the drive cycle TD, and is supplied from the control unit 100 to the drive element 66 via the shared circuit 62 and the switch 64. During the first period T1, the drive signal COM decays from a maintained intermediate voltage Vc to a voltage Vm that is lower than the intermediate voltage Vc, then returns to the intermediate voltage Vc. During the subsequent second period T2, the drive signal COM decays from an intermediate voltage Vc to a voltage V2 that is lower than the intermediate voltage Vc and the voltage Vm, rises to a voltage V1 that is higher than the intermediate voltage Vc, then returns to the intermediate voltage Vc.

The drive signal COM shown in FIG. 5 is a drive signal for inspecting clogs in the discharger 270, and has a waveform different from that of the printing drive signal. During the first period T1, the drive signal COM of FIG. 5 is a signal of a level generating minute vibration in the ink within the cavity 46 without discharging ink from the nozzle 48, and, during the second period T2, the drive signal COM of FIG. 5 is a signal of a level generating residual vibration in the cavity 46 without discharging ink from the nozzle 48.

The detection execution signal DSEL is a logic signal that maintains a low level during the period from when the drive signal COM rises from the intermediate voltage Vc to the voltage V1 during the second period T2 to before when it decays from the voltage V1 to the intermediate voltage Vc, and maintains a high level during other periods when clogs in the discharger 270 are being inspected. The detector 290 of the head unit 200 detects the electric signal HGND of the detection circuit 68 when the detection execution signal DSEL is at a low level, and ceases detecting the electric signal HGND when the detection execution signal DSEL is at a high level.

The switch control signals Tsw1_1-5 are logic signals, synchronous with the detection execution signal DSEL, that maintain a low level during the period from when the drive signal COM rises from the intermediate voltage Vc to the voltage V1 during the second period T2 to before when it decays from the voltage V1 to the intermediate voltage Vc, and maintain a high level during other periods when clogs in the discharger 270 are being inspected. The switches SW1_1-5 stay in an ON state while the switch control signals Tsw1_1-5 is at a high level, and stay in an OFF state while the switch control signals Tsw1_1-5 is at a low level.

When the instruction data of the shift input signal SI is [0,0], the voltage applied to the drive element 66 remains at the intermediate voltage Vc throughout the drive cycle TD. For this reason, no minute vibration or residual vibration is generated in the discharger 270 corresponding to the drive element 66.

When the instruction data of the shift input signal SI is [0,1], the voltage applied to the drive element 66 stays at the intermediate voltage Vc throughout the first period T1, then changes to the voltage V2 and the voltage V1 in the second period T2. For this reason, no minute vibration is generated in the discharger 270 corresponding to the drive element 66, only residual vibration.

When the instruction data of the shift input signal SI is [1,0], the voltage applied to the drive element 66 changes to the voltage Vm in the first period T1, then stays at the intermediate voltage Vc in the second period T2. For this reason, minute vibration is generated in the discharger 270 corresponding to the drive element 66, but no residual vibration. In this embodiment, when the instruction data of the shift input signal SI is [1,0] when clogs in the discharger 270 are being inspected, [it] is set for dischargers 270 not being inspected.

When the instruction data of the shift input signal SI is [1,1], the voltage applied to the drive element 66 changes to the voltage Vm in the first period T1, then changes to the voltage V2 and the voltage V1 in the second period T2. For this reason, minute vibration and residual vibration are generated in the discharger 270 corresponding to the drive element 66. In this embodiment, when the instruction data of the shift input signal SI is [1,1] when clogs in the discharger 270 are being inspected, [it] is set for dischargers 270 being inspected.

To return to FIG. 4, the inspector unit 104 of the control unit 100 inspects the discharger 270 based on the electric signal SW detected by the detector 290 of the head unit 200. In this embodiment, the inspector unit 104 inspects the state of the discharger 270 in terms of clogs (ink bubble formation or thickening) in the nozzle 48 based on the detection signal POUT outputted from the detector 290 of the head unit 200.

The memory unit 108 of the control unit 100 stores determination reference data 130 and inspection results data 140. The determination reference data 130 in the memory unit 108 is data showing a determination reference for determining the state of the discharger 270 on the basis of the electric signal SW, and is stored in the memory unit 108 when the printer 10 is shipped out from the factory. The inspection results data 140 in the memory unit 108 is data showing the results of the inspection of the discharger 270 by the inspector unit 104, and is stored in the memory unit 108 according to the performance of inspection by the inspector unit 104.

Figure 6:
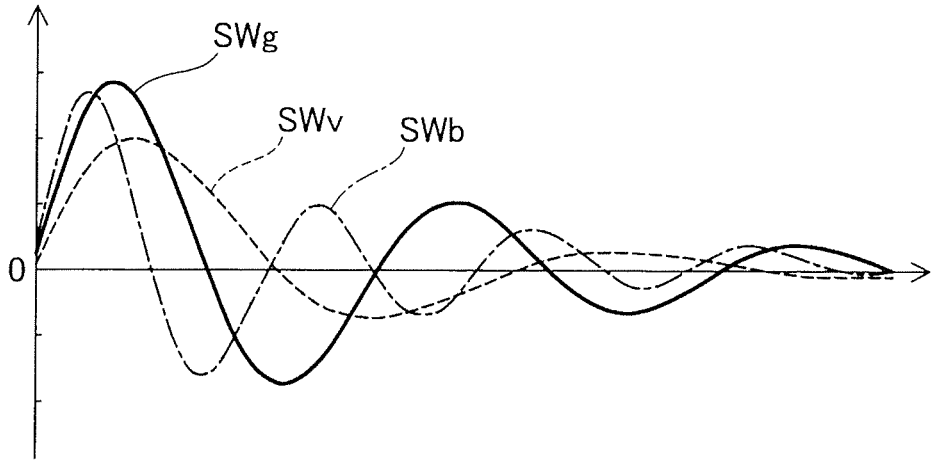
FIG. 6 is an illustration of an example of transformations in electric signals corresponding to residual vibration.

FIG. 6 is an illustration of an example of transformations in electric signals SW corresponding to residual vibration. In FIG. 6, the vertical axis is voltage and the horizontal axis is time, and transformations over times of electric signals SWg, SWb, and SWv are shown.

The electric signal SWg of FIG. 6 illustrates an electric signal SW corresponding to the residual vibration in a single discharger 270 in a state capable of discharging ink. The electric signal SWb of FIG. 6 illustrates an electric signal SW corresponding to the residual vibration in a single discharger 270 in a state not capable of discharging ink due to air bubbles having formed in the ink within the cavity 46. The electric signal SWv of FIG. 6 illustrates an electric signal SW corresponding to the residual vibration in a single discharger 270 in a state not capable of discharging ink due to the ink within the cavity 46 having thickened.

When a step response when a pressure P is applied to a simple harmonic oscillation calculation model assuming the oscillator 67 of the discharger 270 is calculated for a volume rate u, the following formula 1 is obtained.

(Formula 1)

$$u = \frac{P}{\omega \cdot m} e^{-\omega t} \cdot \sin \omega t \ (m^3/s) \tag{1a}$$

$$\omega = \sqrt{\frac{1}{m \cdot c} - \alpha^2} \tag{1b}$$

$$\alpha = \frac{r}{2m} \tag{1c}$$

In the above formula 1, channel resistance r depends on the channel shape of the supply opening 44, cavity 46, nozzle 48, and the like and the viscosity of the ink within these channels; inertance m depends on the mass of the ink within channels such as the supply opening 44, cavity 46, and nozzle 48; and compliance c depends on the elasticity of the oscillator 67.

When air bubbles have formed in the ink within the cavity 46, the amount of ink within the cavity 46 decreases, and inertance m is mainly reduced. When inertance m is reduced, angular velocity ω increases, as shown in formula 1 above. Thus, the vibration cycle of electric signal SWb, which illustrates a state in which air bubbles have formed, is shorter than that of electric signal SWg, as shown in FIG. 6.

When the ink in cavity 46 has thickened, channel resistance r increases. When channel resistance r increases, angular velocity ω decreases, as shown in formula 1 above. Thus, the vibration cycle of electric signal SWv, which illustrates a state in which the ink has thickened, is longer than that of electric signal SWg, and has a greater degree of attenuation than electric signal SWg, as shown in FIG. 6.

A2. Printer Operation

Figure 7:
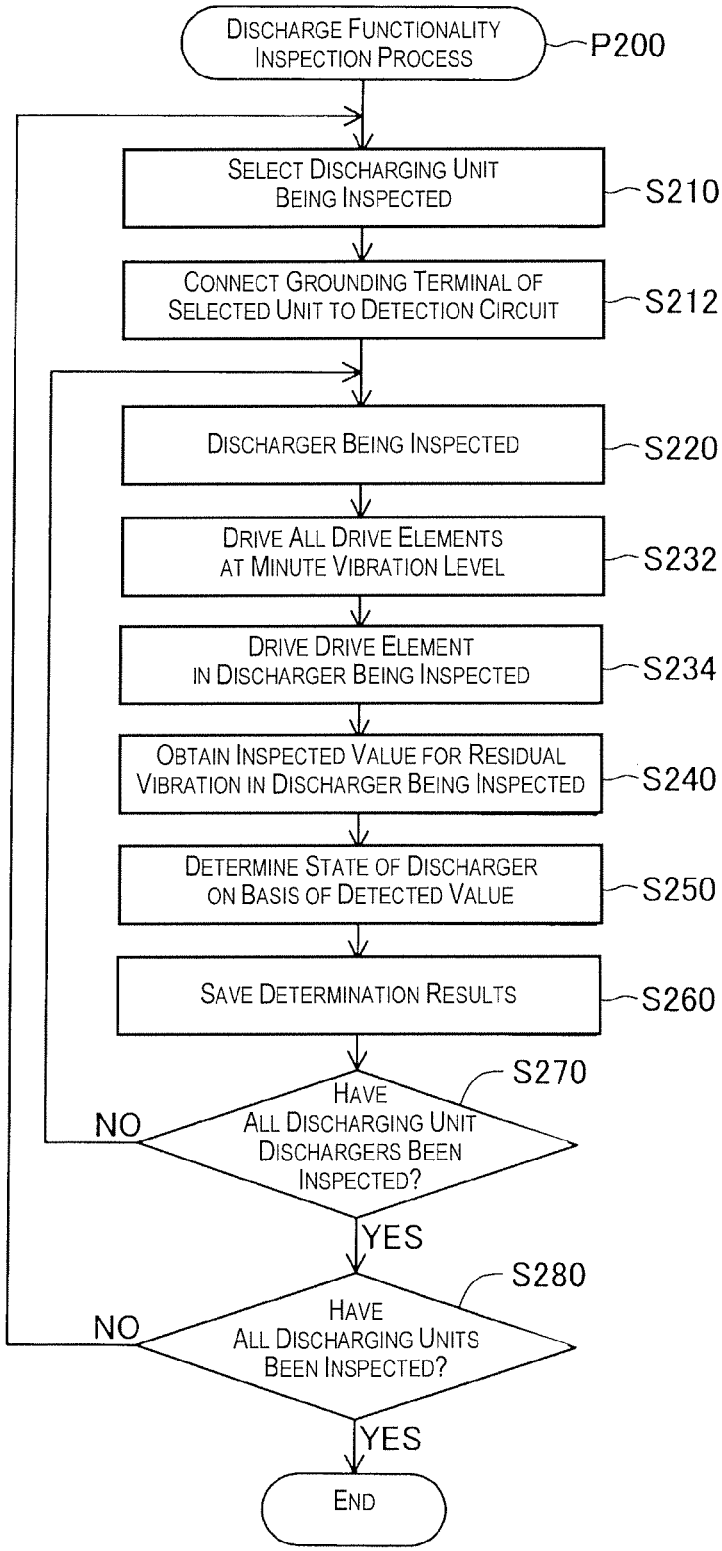
FIG. 7 is a flow chart showing the details of a discharge functionality inspection process performed by a control unit of a printer.

FIG. 7 is a flow chart showing the details of a discharge functionality inspection process P200 performed by a control unit 100 of a printer 10. The discharge functionality inspection process P200 is a process of inspecting the plurality of dischargers 270 of the head unit 200 on the basis of residual vibration. In this embodiment, the discharge functionality inspection process P200 is effected by the CPU of the control unit 100 operating as an inspector unit 104 on the basis of a computer program. In this embodiment, the control unit 100 initiates the discharge functionality inspection process P200 at a preset time, or on the basis of instructions inputted by a user.

When the discharge functionality inspection process P200 is initiated, the control unit 100 selects a discharging unit 78 to be inspected from among the discharging units 78_1-5 for each color (step S210), and electrically connects the grounding terminal 72 of the selected discharging unit 78 to the detection circuit 68 via the switch SW3 (step S212). In this embodiment, the control unit 100 selects a corresponding discharging unit 78 in the order photo black, matte black, cyan, magenta, and yellow.

In this embodiment, the control unit 100 outputs the switch control signal TSW to the head unit 200 and controls the switch SW3 of the head unit 200, thereby electrically connecting the grounding terminal 72 of the discharging unit 78 being inspected to the detection circuit 68, and electrically disconnects the grounding terminals 72 of discharging units 78 not being inspected from the detection circuit 68. For example, when photo black discharging unit 78_1 is selected for inspection, the switch SW3 electrically connects the grounding terminal 72_1 of the discharging unit 78_1 to the detection circuit 68, and electrically disconnects the grounding terminals 72_2-5 of the discharging units 78_2-5 from the detection circuit 68.

After connecting the grounding terminal 72 of the discharging unit 78 being inspected to the detection circuit 68 (step S212), the control unit 100 selects for inspection one of the plurality of dischargers 270 in the configuration of the discharging unit 78 being inspected (step S220). After selecting a discharger 270 for inspection (step S220), the control unit 100 operates as the drive control unit 102, thereby driving all the drive elements 66 in the head unit 200 to a level generating minute vibration (step S232), then drives the drive elements 66 of the discharger 270 being inspected at a level generating residual vibration (step S234).

Specifically, the control unit 100 sets [1,1] as the instruction data of the shift input signal SI corresponding to the discharger 270 being inspected, sets [1,0] as the instruction data of the shift input signal SI corresponding to the other dischargers 270, and outputs the latching signal LAT, drive signal COM, and detection execution signal DSEL to the head unit 200 along with the shift input signal SI and clock signal SCK, as shown in FIG. 5. Residual vibration is thereby generated in the ink within the cavity 46 of the discharger 270 being inspected after minute vibration is generated in the ink within the cavities 46 of all the dischargers 270 within the head unit 200, and the electric signal SW corresponding to the residual vibration is applied from the drive element 66 of the discharger 270 being inspected to the detection circuit 68 via the grounding terminal 72 and the switch SW3. At that time, the detector 290 of the head unit 200 detects the electric signal SW through the detection circuit 68, and outputs the detection signal POUT, which indicates the detected value of the electric signal SW resulting from the detection, to the control unit 100.

When the electric signal SW is detected by the detector 290, the switches SW1_1-5 electrically disconnect their respective grounding terminals 72 from the grounding line GL. Prior to the disconnection of the grounding terminals 72 from the grounding line GL by the switches SW1_1-5, the switch SW3 electrically connects the grounding terminal 72 corresponding to the discharging unit 78 being inspected to the detection circuit 68, and electrically disconnects the grounding terminals 72 of discharging units 78 not being inspected from the detection circuit 68.

After driving the drive element 66 being inspected (step S234), the control unit 100 obtains a detected value for the electric signal SW from the detection signal POUT outputted from the detector 290 of the head unit 200 (step S240), and determines the state of the discharger 270 being inspected based on the detected value of the electric signal SW (step S250). After determining the state of the discharger 270 being inspected (step S250), the control unit 100 saves the determined results in the memory unit 108 as inspection results data 140 (step S260).

After saving the determined results (step S260), the control unit 100 repeats the process beginning with selecting the discharger 270 being inspected (step S220) until all of the plurality of dischargers 270 in the discharging unit 78 being inspected have been inspected (step S270: NO). When all of the plurality of dischargers 270 in the discharging unit 78 being inspected have been inspected (step S270: YES), the control unit 100 repeats the process beginning with the selection of the discharging unit 78 being inspected (step S210) until all of the discharging units 78 in the head unit 200 have been inspected (step S280: NO). When all of the discharging units 78 in the head unit 200 have been inspected (step S280: YES), the control unit 100 finishes the discharge functionality inspection process P200.

Figure 8:
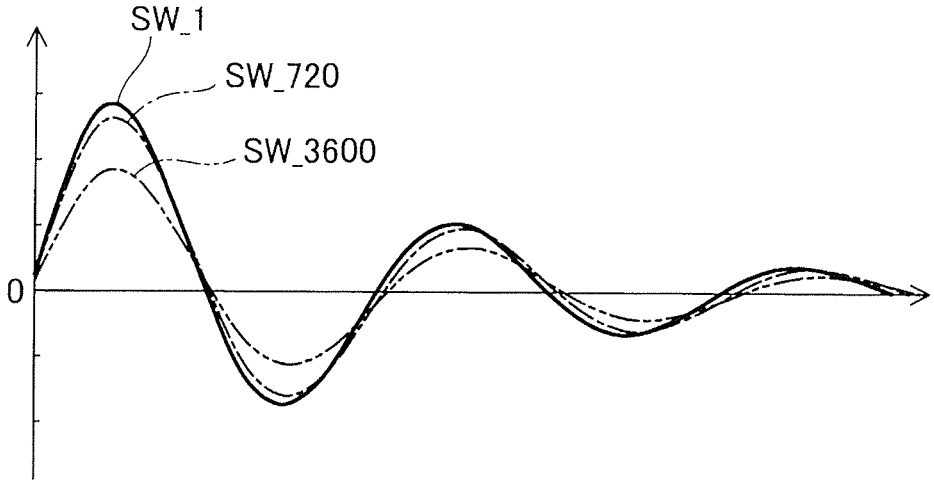
FIG. 8 is an illustration of electric signal testing results detected by a detection circuit.

FIG. 8 is an illustration of electric signal SW testing results detected by a detection circuit 68. In FIG. 8, the vertical axis is voltage and the horizontal axis is time, and transformations over times of electric signals SW_1, SW_720, and SW_3600 are shown. The electric signals SW_1, SW_720, and SW_3600 are electric signals SW detected from the detection circuit 68 connected to discharging units 78 each having a different configuration.

The electric signal SW_1 indicates an electric signal SW detected from the detection circuit 68 when the electric signal SWg is outputted from a single drive element 66 being inspected in a discharging unit 78 in which one drive element 66 is connected to the grounding terminal 72. In the case of the electric signal SW_1, there is no switch 64 in an OFF state and electrically connected in parallel to the drive element 66 being inspected present between the shared circuit 62 and the grounding terminal 72, with the result that the electric signal SW_1 is not subjected to the effects of the parasitic capacity of a switch 64 in an OFF state, and presents an aspect equivalent to that of the electric signal SWg outputted from the drive element 66 being inspected.

The electric signal SW_720 indicates an electric signal SW detected from the detection circuit 68 when the electric signal SWg is outputted from a single drive element 66 being inspected in a discharging unit 78 in which 720 drive elements 66 are connected to the grounding terminal 72. In the case of the electric signal SW_720, there are 719 switches 64 in an OFF state and electrically connected in parallel to the drive element 66 being inspected present between the shared circuit 62 and the grounding terminal 72, with the result that the electric signal SW_720 is subjected to the effects of the parasitic capacities of 719 switches 64 in an OFF state, and the signal level thereof is lower than that of the electric signal SW_1.

The electric signal SW_3600 indicates an electric signal SW detected from the detection circuit 68 when the electric signal SWg is outputted from a single drive element 66 being inspected in a discharging unit 78 in which 3600 drive elements 66 are connected to the grounding terminal 72. In the case of the electric signal SW_3600, there are 3,599 switches 64 in an OFF state and electrically connected in parallel to the drive element 66 being inspected present between the shared circuit 62 and the grounding terminal 72, with the result that the electric signal SW_3600 is subjected to the effects of the parasitic capacities of 3,599 switches 64 in an OFF state, and the signal level thereof is even lower than that of the electric signal SW_720.

From the results of FIG. 8, it is apparent that the fewer the drive elements 66 connected to the grounding terminal 72, the more reduction of the level of the electric signal SW outputted from the drive element 66 being inspected can be suppressed.

A3. Results:

In the printer 10 according to the first embodiment described above, the first grounding terminal, which is the grounding terminal 72 of the discharging unit 78 in which the drive element 66 of the discharger 270 being inspected (first drive element) is incorporated, and the second grounding terminal, which is the grounding terminal 72 of the discharging unit 78 in which only the drive elements 66 of the discharger 270 not being inspected (second drive elements) are incorporated, are electrically disconnected when the electric signal SW is being detected by the detector 290, with the result that reductions in the level of the electric signal SW corresponding to the residual vibration caused by a parasitic capacity of the switch 64 can be suppressed. It is thereby possible to suppress false determinations during inspection of the discharger 270 on the basis of residual vibration.

Also, having a grounding terminal 72 provided for every n drive elements 66 corresponding to each color allows for a simpler configuration than if a grounding terminal 72 were provided for every drive element 66.

Also, having each drive element 66 of the plurality of dischargers 270 incorporated in one discharging unit 78 be connected to the grounding terminal 72 formed in the discharging unit 78 allows for a simpler configuration than if the correspondence between drive element 66 and grounding terminal 72 were to be across multiple discharging units 78.

Also, because the drive elements 66 of the discharger 270 being inspected are driven at a level generating residual vibration (step S234) after all of the drive elements 66 are driven at a level generating minute vibration (step S232), it is possible to agitate the ink within the cavities 46 of the dischargers 270 not being inspected and prevent thickening of the ink in the dischargers 270 not being inspected.

B. Second Embodiment

Figure 9:
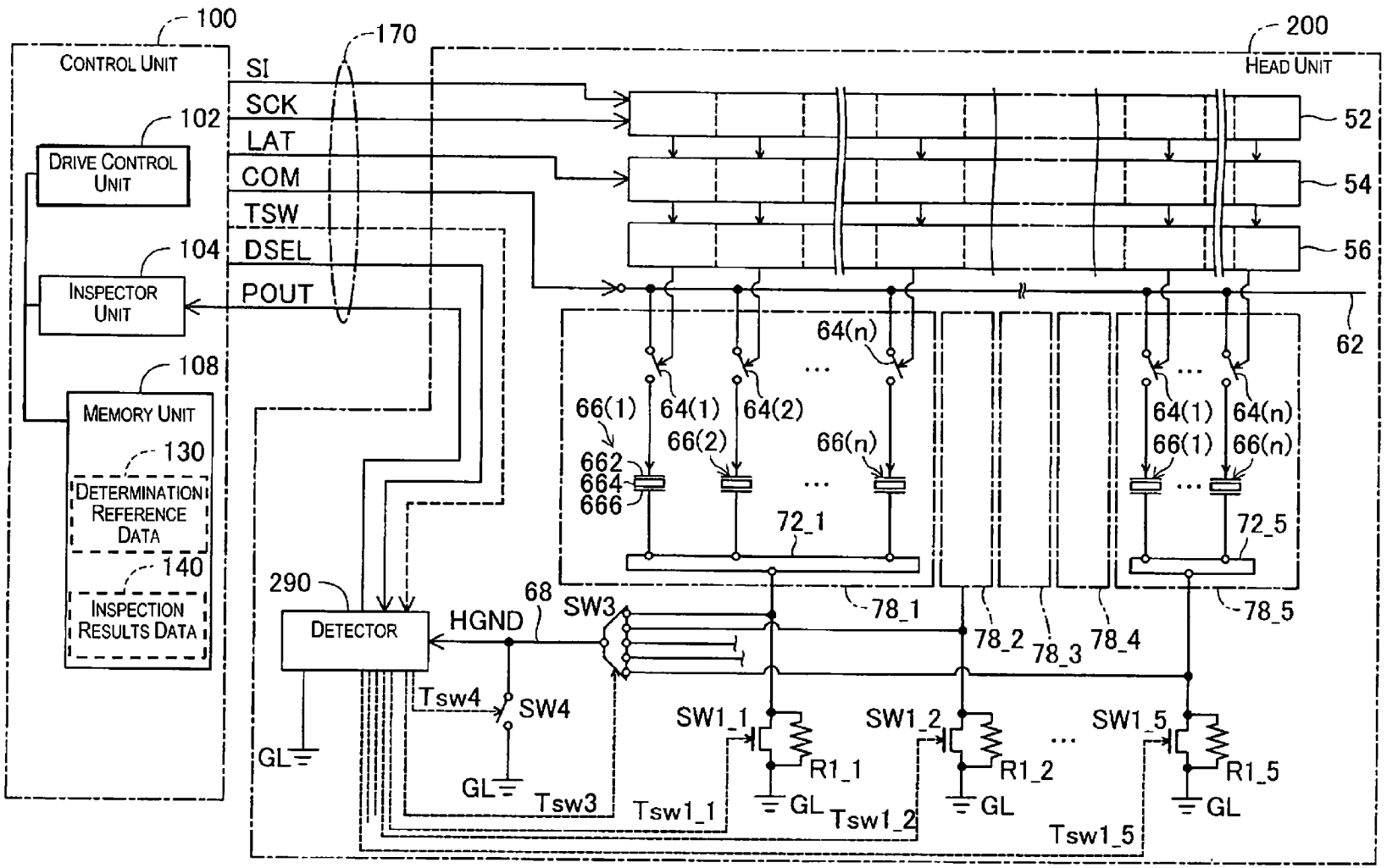
FIG. 9 is an illustration of the electronic configuration of a control unit and a head unit according to a second embodiment.

FIG. 9 is an illustration of the electronic configuration of a control unit 100 and a head unit 200 according to a second embodiment. A printer 10 according to the second embodiment is identical to that of the first embodiment, except that the printer of the second embodiment has a switch SW4 connecting the detection circuit 68 of the head unit 200 to the grounding line GL, and the operation of the switches SW1_1-5 differs. In this embodiment, the switch SW4 is an analog switch utilizing a transmission gate. In the second embodiment, the detector 290 outputs a switch control signal Tsw4 controlling the switch SW4 along with the switch control signals Tsw1_1-5 controlling the switches SW1_1-5 and the switch control signal Tsw3 controlling the switch SW3 on the basis of the switch control signal TSW, output from the control unit 100 along with the detection execution signal DSEL.

Figure 10:
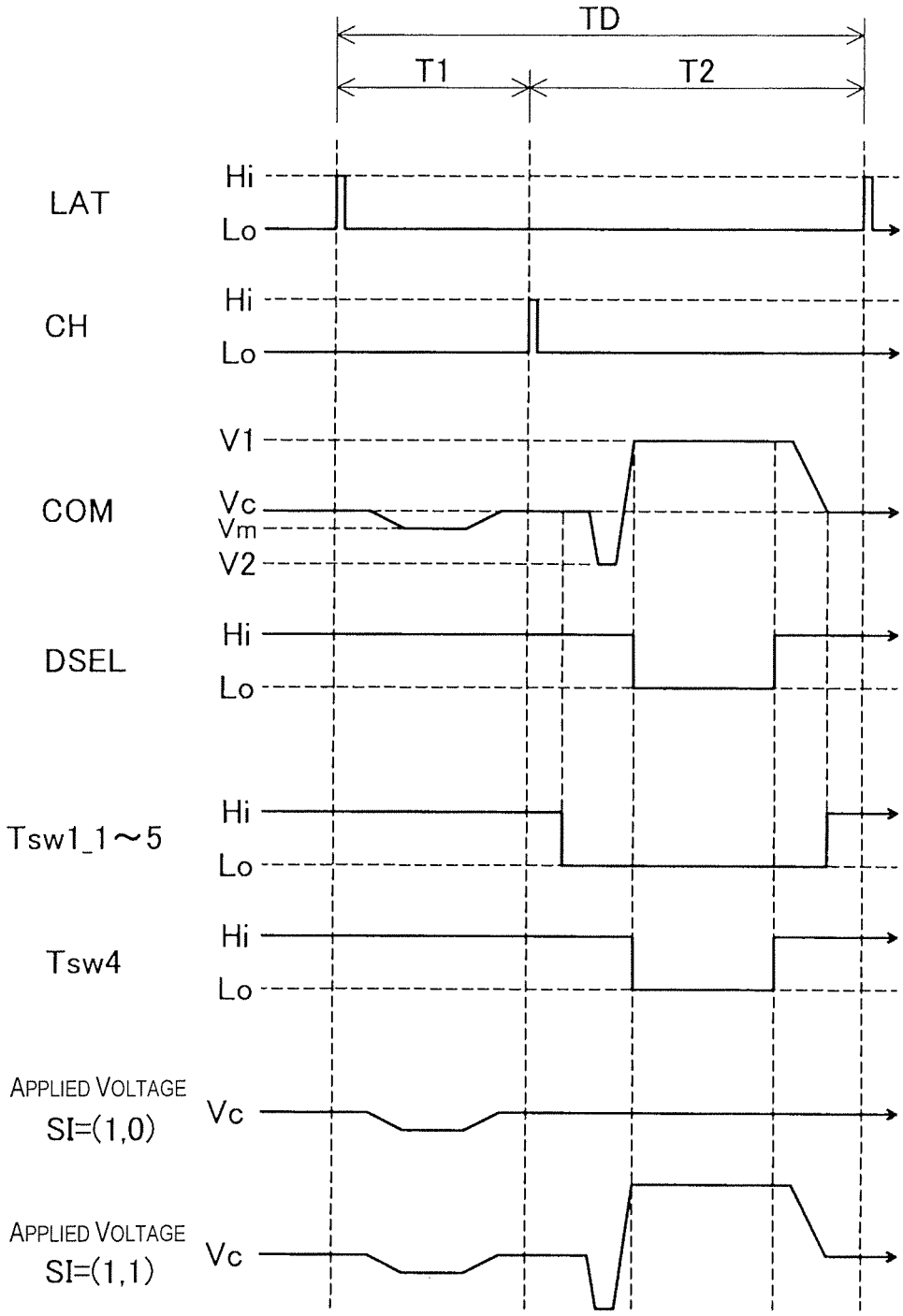
FIG. 10 is an illustration of various signals from a control unit and a head unit according to a second embodiment.

FIG. 10 is an illustration of various signals from a control unit 100 and a head unit 200 according to a second embodiment. From the top, FIG. 10 shows the changes over time in the latching signal LAT, a switching signal CH, the drive signal COM, the detection execution signal DSEL, the switch control signals Tsw1_1-5, the switch control signal Tsw4, and, underneath that, the changes over time in the voltage applied to the drive element 66 according to the instruction data in the shift input signal SI. The various signals of the second embodiment are identical to those of the first embodiment, except that the operation timings of the switch control signals Tsw1_1-5 differ, and the switch control signal Tsw4 is output.

The switch control signals Tsw1_1-5 of the second embodiment are logic signals that maintain a low level during the period from before when the drive signal COM falls to the voltage V2 during the second period T2 until when the drive signal COM falls from the voltage V1 to the intermediate voltage Vc and maintain a high level during other periods. While the switch control signals Tsw1_1-5 are at a high level, the switches SW1_1-5 maintain an ON state and electrically connect the grounding terminals 72_1-5 to the grounding line GL. While the switch control signals Tsw1_1-5 are at a low level, the switches SW1_1-5 maintain an OFF state and electrically disconnect the grounding terminals 72_1-5 from the grounding line GL.

The switch control signal Tsw4 of the second embodiment is a logic signal, synchronous with the detection execution signal DSEL, that maintains a low level during the period from when the drive signal COM rises from the intermediate voltage Vc to the voltage V1 during the second period T2 to before when it decays from the voltage V1 to the intermediate voltage Vc, and maintains a high level during other periods when clogs in the discharger 270 are being inspected. While the switch control signal Tsw4 is at a high level, the switch SW4 maintains an ON state and electrically connects the detection circuit 68 to the grounding line GL. While the switch control signal Tsw4 is at a low level, the switch SW4 maintains an OFF state and electrically disconnects the detection circuit 68 from the grounding line GL.

In the printer 10 according to the second embodiment described above, as with that of the first embodiment, it is possible to suppress reductions in the level of the electric signal SW corresponding to the residual vibration arising from a parasitic capacity of the switch 64, with the result that false determinations during inspection of the discharger 270 on the basis of residual vibration can be suppressed. Thanks to the switch SW4 provided in the detection circuit 68, it is also possible to perform the operation of electrically disconnecting the grounding terminal 72 corresponding to the discharger 270 being inspected from the grounding line GL comparatively faster than in the first embodiment.

C. Third Embodiment

A printer 10 according to a third embodiment is identical to that of the second embodiment, except that the operation of the switches SW1_1-5 differs.

Figure 11:
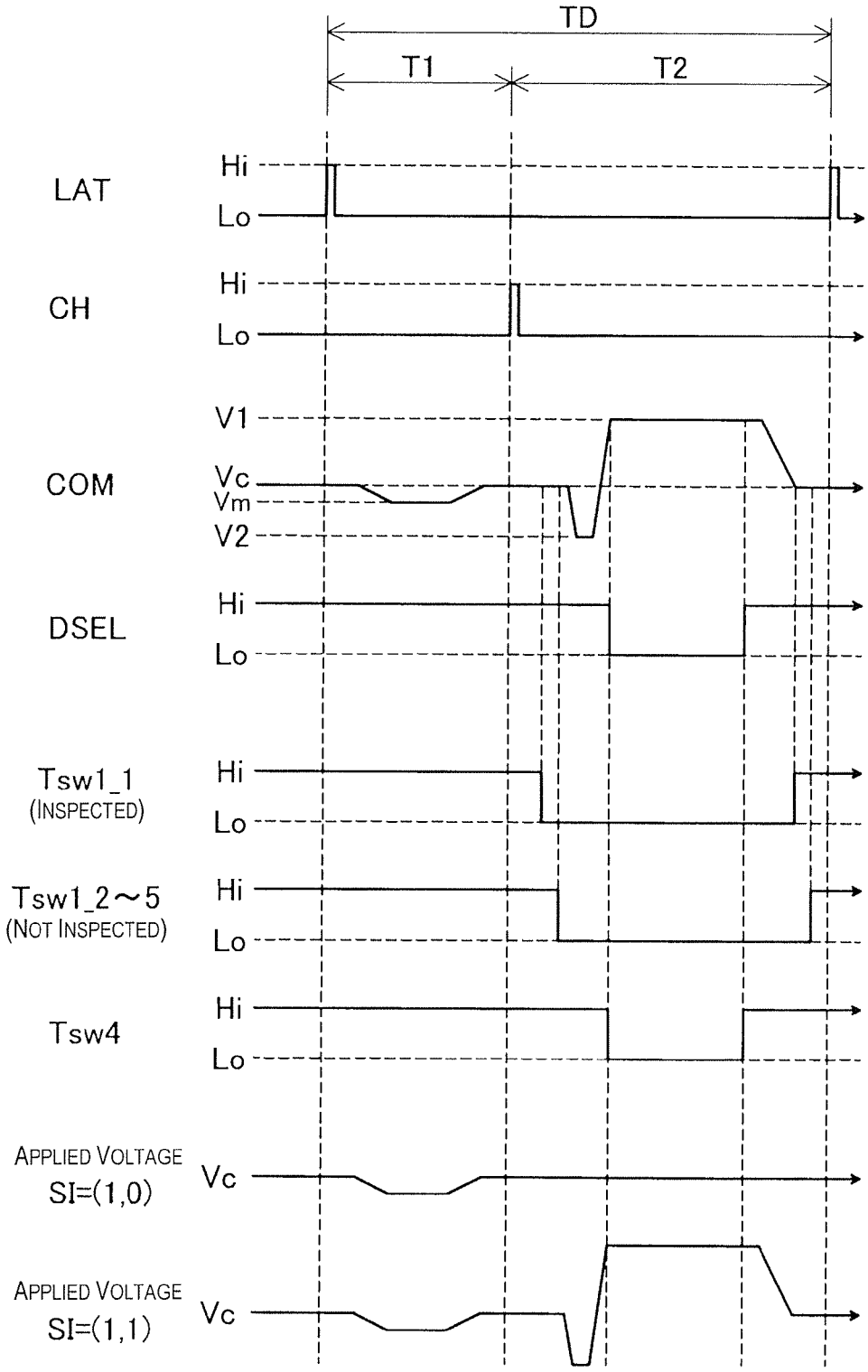
FIG. 11 is an illustration of various signals from a control unit and a head unit according to a third embodiment.

FIG. 11 is an illustration of various signals from a control unit 100 and a head unit 200 according to a third embodiment. From the top, FIG. 11 shows the changes over time in the latching signal LAT, a switching signal CH, the drive signal COM, the detection execution signal DSEL, the switch control signals Tsw1_1-5, the switch control signal Tsw4, and, underneath that, the changes over time in the voltage applied to the drive element 66 according to the instruction data in the shift input signal SI. The switch control signals Tsw1_1-5 shown in FIG. 11 indicate a state in which, out of the discharging units 78_1-5, discharging unit 78_1 has been selected for inspection, and discharging units 78_2-5 have not been selected for inspection.

The switch control signals Tsw1_1-5 according to the third embodiment change like those of the second embodiment, except that the switch control signal Tsw1_1 corresponding to the switch SW1_1 of the discharging unit 78_1 being inspected and the switch control signals Tsw1_2-5 corresponding to the switches SW1_2-5 of the discharging units 78_2-5 not being inspected have staggered low level periods. In the example of FIG. 11, the lengths of the low level periods of the switch control signals Tsw1_1-5 are the same, but the switch control signal Tsw1_1 enters the low level period before the switches SW1_2-5. It is thereby possible to stagger the operation timings of the switch SW1_1 and the switches SW1_2-5, reducing the current flowing through the switches SW1_1-5 when switching between ON and OFF states is being performed.

In the printer 10 according to the third embodiment described above, as with that of the first embodiment, it is possible to suppress reductions in the level of the electric signal SW corresponding to the residual vibration arising from a parasitic capacity of the switch 64, with the result that false determinations during inspection of the discharger 270 on the basis of residual vibration can be suppressed. Thanks to the switch SW4 provided in the detection circuit 68, it is also possible to perform the operation of electrically disconnecting the grounding terminal 72 corresponding to the discharger 270 being inspected from the grounding line GL comparatively faster than in the first embodiment.

D. Other Embodiments

Various embodiments of the invention have been described above, but the invention is in no way limited to the embodiments described above, and a variety of embodiments within the scope of the invention are possible.

For instance, in the embodiments described above, the drive elements 66 were driven at a level such that residual vibration was generated without ink droplets being discharged and residual vibration was detected, but in another embodiment, the drive elements 66 can be driven at a level such that ink droplets are discharged and residual vibration is detected.

In the embodiments described above, a discharge functionality inspection process P200 was performed at a timing different from that at which printing was performed on the print medium 90, but in another embodiment, the discharger 270 can be inspected on the basis of the electric signal SW corresponding to the residual vibration while printing is being performed on the print medium 90.

In the embodiments described above, all drive elements 66 in the head unit 200 were driven at a level generating minute vibration before the drive element 66 of the discharger 270 being inspected was driven (step S232), but in another embodiment, the drive element 66 of the discharger 270 being inspected without driving all the drive elements 66 at a level generating minute vibration.

In the embodiments described above, grounding terminals 72_1-5 were provided for each color of ink discharged from the discharger 270, but in another embodiment, when the plurality of dischargers 270 are divided into a plurality of groups, each of which discharges ink at different timings (for example, refer to the technique disclosed in Unexamined Japanese Patent Application Publication 2010-221499), grounding terminals 72 can be provided for each of these groups. For example, when there is a group of nozzles 48(1)-48($n$/2) and a group of nozzles 48(($n$*2)+1)-48($n$) for each color, with each group discharging ink at different timings, a grounding terminal connected to drive elements 66(1)-66($n$/2) corresponding to the group of nozzles 48(1)-48($n$/2) and a grounding terminal connected to drive elements 66(($n$*2)+1)-66($n$) corresponding to the group of nozzles 48(($n$*2)+1)-48($n$) can be separately provided. It is thereby possible to more easily perform inspection of the discharger 270 while discharging ink than if dischargers 270 discharging ink at different timings were connected to the grounding line GL via a shared grounding terminal 72.

Figure 12:
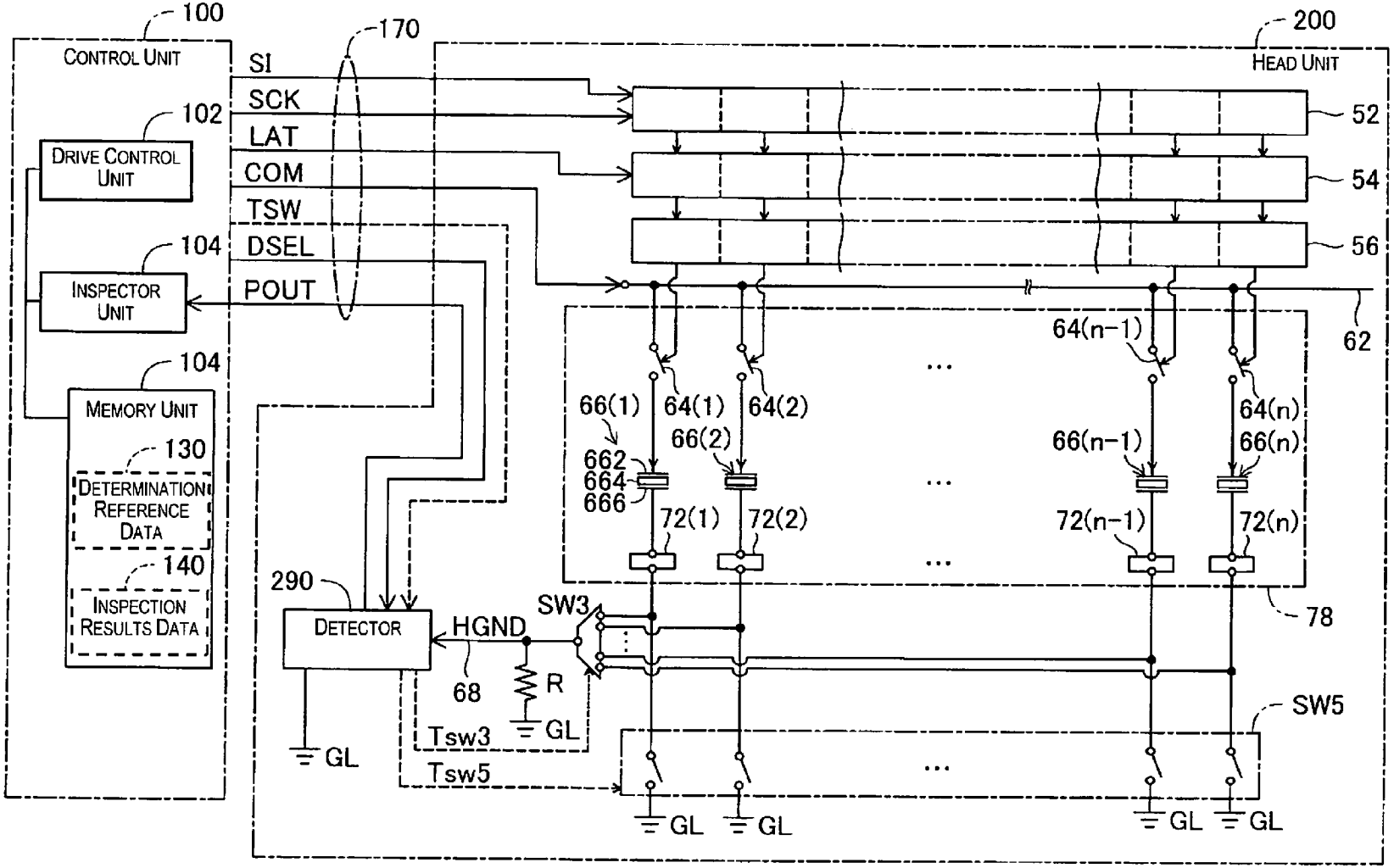
FIG. 12 is an illustration of the electronic configuration of a control unit and a head unit according to another embodiment.

From considerations of suppressing reductions in the level of the electric signal SW due to the parasitic capacity of the switch 64, it is preferable that fewer drive elements 66 be connected to one grounding terminal 72, and most preferable that one drive element 66 be connected to one grounding terminal 72. FIG. 12 is an illustration of the electronic configuration of a control unit 100 and a head unit 200 according to another embodiment. The example shown in FIG. 12 is provided with a grounding terminal 72 for every drive element 66, and a switch SW5 performs electrical connection of each of these grounding terminals 72 and the grounding line GL.

In the above embodiments, an inkjet printer discharging ink was described as one example of a liquid discharging apparatus, but the liquid discharged by the liquid discharging apparatus of the invention is not limited to ink, and can be liquids of various sorts, or a fluid in which a solid is dispersed in a liquid or a gas. For instance, the invention is not limited to inkjet-format printers, and can be applied to other printer formats as well. The invention can also be applied to a discharge apparatus used in manufacturing liquid crystal displays, organic electroluminescence (EL) displays, field emission displays (FEDs), and the like that discharges a liquid containing an electrode material, colorant, or other such materials in a dispersed or molten state. The invention can also be applied to a discharge apparatus used in manufacturing biochips that discharges a liquid containing a bioorganic material. The invention can also be applied to a discharge apparatus using in manufacturing precision pipettes that discharges a liquid specimen. The invention can also be applied to a discharge apparatus for pinpoint discharging of lubricant onto precise machinery such as clockwork and cameras, to a discharge apparatus for discharging UV-curing resins and other clear resin liquids used in forming fine hemisphere lenses (optical lenses) used in optical communication elements, or the like. The invention can also be applied to a discharge apparatus for discharging an etchant for etching a wafer, to a discharge apparatus for discharging toner or other powders, or the like.

The entire disclosure of Japanese Patent Application No. 2011-088828, filed Apr. 13, 2011 is expressly incorporated by reference herein.

What is claimed is:

1. A liquid discharging apparatus comprising:

a grounding line;

a first discharger configured to discharge, by driving of a first drive element, a liquid in a first cavity through a first nozzle communicating with the first cavity;

a first grounding terminal connecting the first drive element to the grounding line;

a second discharger configured to discharge, by driving of a second drive element, a liquid in a second cavity through a second nozzle communicating with the second cavity;

a second grounding terminal connecting the second drive element to the grounding line;

a shared circuit selectively connectable to the first drive element and the second drive element via respective analog switches;

a drive control unit configured to control the driving of each of the first drive element and the second drive element via the shared circuit;

a switch unit configured to electrically disconnect the first grounding terminal from the second grounding terminal and the grounding line;

a detector configured to detect an electric signal from the first drive element via the first grounding terminal when the first grounding terminal is electrically disconnected from the second grounding terminal and the grounding line, the detector being arranged to be electrically connected to the first ground terminal and to the second ground terminal; and an inspector unit configured to inspect the first discharger based on the electric signal, the switch unit having a first switch, a second switch, and a third switch, the first switch disposed between the first grounding terminal and the grounding line, the second switch disposed between the second grounding terminal and the grounding line, the third switch being disposed between the first grounding terminal and the detector, and between the second grounding terminal and the detector, the detector detecting the electric signal from the first drive element via the first grounding terminal while the first switch disconnects the first grounding terminal from the grounding line, the second switch disconnects the second grounding terminal from the grounding line, the third switch connects the first grounding terminal and the detector, and the third switch disconnects the second grounding terminal from the detector.

2. The liquid discharging apparatus according to claim 1, further comprising a third discharger configured to discharge, by driving of a third drive element, a liquid in a third cavity through a third nozzle communicating with the third cavity; and a fourth discharger configured to discharge, by driving of a fourth drive element, a liquid in a fourth cavity through a fourth nozzle communicating with the fourth cavity; wherein the third drive element is connected to the grounding line along with the first drive element via the first grounding terminal; and the fourth drive element is connected to the grounding line along with the second drive element via the second grounding terminal.

3. The liquid discharging apparatus according to claim 2, wherein the first discharger and the third discharger are incorporated in a first unit in which the first grounding terminal is formed; and the second discharger and the fourth discharger are incorporated in a second unit in which the second grounding terminal is formed.

4. The liquid discharging apparatus according to claim 2, wherein the liquid is discharged at different timings by the first and third dischargers, and the second and fourth dischargers, respectively.

5. A liquid discharging apparatus according to claim 1, wherein the third switch electrically connects the first grounding terminal to the detector and electrically disconnects the second grounding terminal from the detector prior to the disconnection performed by the first switch and the second switch.

6. A liquid discharging apparatus according to claim 1, wherein the third switch electrically connects the first grounding terminal to a detection circuit electrically connected to the detector and the grounding line and electrically disconnecting the second grounding terminal from the detection circuit prior to the disconnection performed by the first switch and the second switch, and the switch unit further includes a fourth switch configured to electrically disconnect the detection circuit from the grounding line after the disconnection performed by the first switch and the second switch when the electric signal is detected by the detector.

7. The liquid discharging apparatus according to claim 1, wherein the drive control unit drives the first drive element and the second drive element at a level such that liquid is not discharged, and then drives the first drive element at a level such that residual vibration by the driving of the first drive element is generated.

8. An inspection method for inspecting a liquid discharging apparatus, comprising:

controlling driving of each of a first drive element of a first discharger and a second drive element of a second discharger via a shared circuit selectively connectable to the first drive element and the second drive element, the first drive element being driven such that the first discharger discharges a liquid in a first cavity through a first nozzle communicating with the first cavity, the first drive element being connected to a grounding line via a first grounding terminal, the second drive element being driven such that the second discharger discharges a liquid in a second cavity through a second nozzle communicating with the second cavity, the second drive element being connected to the grounding line via a second grounding terminal;

detecting an electric signal from the first drive element via the first grounding terminal by a detector arranged to be electrically connected to the first ground terminal and to the second ground terminal while the first grounding terminal is in a state of being electrically disconnected from the second grounding terminal and the grounding line; and inspecting the first discharger on the basis of the electric signal, the detecting of the electric signal including detecting the electric signal from the first drive element via the first grounding terminal while disconnecting the first grounding terminal from the grounding line by a first switch, disconnecting the second grounding terminal from the grounding line by a second switch, connecting the first grounding terminal and the detector by a third switch, and disconnecting the second grounding terminal from the detector by the third switch, the first being disposed between the first grounding terminal and the grounding line, the second switch being disposed between the second grounding terminal and the grounding line, the third switch being disposed between the first grounding terminal and the detector, and between the second grounding terminal and the detector.

9. A non-transitory computer readable medium having recorded program for causing a computer to execute a function of inspecting a liquid discharging apparatus, the program being adapted for executing functions of:

controlling driving of each of a first drive element of a first discharger and a second drive element of a second discharger via a shared circuit selectively connectable to the first drive element and the second drive element, the first drive element being driven such that the first discharger discharges a liquid in a first cavity through a first nozzle communicating with the first cavity, the first drive element being connected to a grounding line via a first grounding terminal, the second drive element being driven such that the second discharger discharges a liquid in a second cavity through a second nozzle communicating with the second cavity, the second drive element being connected to the grounding line via a second grounding terminal;

detecting an electric signal from the first drive element via the first grounding terminal by a detector arranged to be electrically connected to the first ground terminal and to the second ground terminal while the first grounding terminal is in a state of being electrically disconnected from the second grounding terminal and the grounding line; and inspecting the first discharger based on the electric signal;

the medium being accessible by the computer;

the detecting of the electric signal including detecting the electric signal from the first drive element via the first grounding terminal while disconnecting the first grounding terminal from the grounding line by a first switch, disconnecting the second grounding terminal from the grounding line by a second switch, connecting the first grounding terminal and the detector by a third switch, and disconnecting the second grounding terminal from the detector by the third switch, the first being disposed between the first grounding terminal and the grounding line, the second switch being disposed between the second grounding terminal and the grounding line, the third switch being disposed between the first grounding terminal and the detector, and between the second grounding terminal and the detector.

* * * * *